US007044486B2

(12) United States Patent
Wright et al.

(10) Patent No.: US 7,044,486 B2
(45) Date of Patent: May 16, 2006

(54) SKATEBOARD WITH SUSPENSION SYSTEM

(75) Inventors: Steven P. Wright, Beaverton, OR (US); Raymond W. Riley, Portland, OR (US); Willem J. Schoonhoven, Amsterdam (NL); Merijn Hartog, Amsterdam (NL); Lucien H. Vink, The Hague (NL); Michiel S. Knoppert, Amsterdam (NL)

(73) Assignee: Nike, Inc., Beaverton, OR (US)

( * ) Notice: Subject to any disclaimer, the term of this patent is extended or adjusted under 35 U.S.C. 154(b) by 110 days.

(21) Appl. No.: 10/738,638

(22) Filed: Dec. 17, 2003

(65) Prior Publication Data

US 2005/0134013 A1 Jun. 23, 2005

(51) Int. Cl.
*A62M 1/00* (2006.01)

(52) U.S. Cl. ..... 280/87.042; 280/87.041

(58) Field of Classification Search ..... 280/841, 280/608, 610, 601, 11.19, 11.27, 87.01, 87.021, 280/87.041, 87.042, 47.12, 47.131, 37, 11.221, 280/11.3, 11.28, 11.225, 11.231
See application file for complete search history.

(56) References Cited

U.S. PATENT DOCUMENTS

| | | | | |
|---|---|---|---|---|
| 304,949 | A | 9/1884 | Mitchell | |
| 319,939 | A | 6/1885 | Nelson | |
| 326,540 | A | 9/1885 | Baker | |
| 921,102 | A | 5/1909 | Grout | |
| 1,018,512 | A | 2/1912 | Mees | |
| 1,213,454 | A | 1/1917 | Brown | |
| 1,603,529 | A | 10/1926 | Faust | |
| 1,935,187 | A | 11/1933 | Kitselman | |
| 2,027,254 | A | 1/1936 | Vogt | |
| 2,126,359 | A | 8/1938 | Vogt | |
| 2,413,530 | A | 12/1946 | Taylor | |
| 3,331,612 | A | 7/1967 | Tietge | |
| 3,876,217 | A * | 4/1975 | Copier | 280/11.225 |
| 3,891,225 | A * | 6/1975 | Sessa | 280/11.19 |
| 4,152,001 | A * | 5/1979 | Christianson | 280/11.28 |
| D252,347 | S * | 7/1979 | Solheim | D21/765 |
| 4,194,752 | A | 3/1980 | Tilch et al. | 280/11.28 |
| 4,295,656 | A * | 10/1981 | Moore | 280/87.042 |
| 4,645,223 | A | 2/1987 | Grossman | 280/11.28 |
| 4,921,513 | A * | 5/1990 | Parten | 156/280 |
| 4,943,075 | A * | 7/1990 | Gates | 280/842 |
| 5,046,747 | A * | 9/1991 | Nielsen, Jr. | 280/11.28 |
| 5,052,702 | A * | 10/1991 | Chan | 280/11.28 |
| 5,154,436 | A | 10/1992 | Jez et al. | 280/87.042 |
| 5,195,781 | A * | 3/1993 | Osawa | 280/842 |
| 5,860,657 | A * | 1/1999 | Kroher | 280/11.223 |
| 5,947,495 | A | 9/1999 | Null et al. | 280/87.042 |
| 5,984,328 | A * | 11/1999 | Tipton | 280/87.042 |
| 6,224,076 | B1 | 5/2001 | Kent | 280/87.042 |
| 6,318,739 | B1 | 11/2001 | Fehn, Jr. | 280/11.28 |
| 6,398,237 | B1 * | 6/2002 | Attey | 280/87.042 |
| 6,460,868 | B1 * | 10/2002 | Madrid | 280/87.042 |
| 6,527,284 | B1 * | 3/2003 | Bert | 280/87.041 |
| 6,536,788 | B1 | 3/2003 | Kuncz et al. | 280/87.041 |
| 6,782,929 | B1 * | 8/2004 | Madrid | 144/349 |
| 6,848,527 | B1 * | 2/2005 | Nelson | 180/181 |

* cited by examiner

*Primary Examiner*—Christopher P. Ellis
*Assistant Examiner*—Kelly E. Campbell
(74) *Attorney, Agent, or Firm*—Banner & Witcoff, Ltd.

(57) ABSTRACT

A skateboard includes a board having a tip portion and a tail portion. A substantially U-shaped first aperture is formed in the tip portion, with an open end of the first aperture opening toward a central portion of the board. A substantially U-shaped second aperture is formed in the tail portion, with an open end of the second aperture opening toward a central portion of the board.

28 Claims, 4 Drawing Sheets

SKATEBOARD WITH SUSPENSION SYSTEM

FIELD OF THE INVENTION

This invention relates generally to skateboards, and, in particular, to skateboards having improved suspension systems and improved flexibility.

BACKGROUND OF THE INVENTION

Skateboards are well known in the art, and are typically formed of a board comprising multiple layers. A pair of trucks is pivotally secured to an underside of the board. An axle with a wheel at each end is secured to each truck. The pivotable trucks allow a user to flex the board from one side to the other, thereby allowing the user to turn the board in either direction by leaning to that side.

Skateboarders often use their boards to perform various tricks, including, for example, flipping, lifting and twisting their board. In order to perform the flips, twists and other tricks carried out in competitive and recreational use of skateboards, the board must be very flexible, yet strong. Since many of the tricks performed include hard landings and riding over rough surfaces, absorption of shocks is also an important requirement for skateboard construction.

Skateboard competitions have become increasingly prevalent, and the award money and competition present at such events have naturally increased the complexity of the tricks performed by skateboard users. Accordingly, the requirement for flexibility and strength in the boards has increased as well. However, present skateboards are limited in the amount of flexibility they exhibit.

It is an object of the present invention to provide a skateboard suspension system that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, a skateboard includes a board having a tip portion and a tail portion. A substantially U-shaped first aperture is formed in the tip portion, with an open end of the first aperture opening toward a central portion of the board. A substantially U-shaped second aperture is formed in the tail portion, with an open end of the second aperture opening toward a central portion of the board.

In accordance with another aspect, a skateboard assembly includes a board having a tip portion and a tail portion. A first truck is secured to the tip portion of the board, and has an axle and a wheel rotatably secured to each end of the axle. A second truck is secured to the tail portion of the board, and has an axle and a wheel rotatably secured to each end of the axle. A substantially U-shaped first aperture is formed in the board and substantially surrounds the first truck, with an open end of the first aperture opening toward a central portion of the board. A substantially U-shaped second aperture is formed in the board, and substantially surrounds the second truck; with an open end of the second aperture opening toward a central portion of the board.

Substantial advantage is achieved by providing a skateboard with an improved suspension system. In particular, improved flexibility of the skateboard can be realized, allowing a user to perform more tricks and enjoy a better and smoother ride.

These and additional features and advantages of the invention disclosed here will be further understood from the following detailed disclosure of certain preferred embodiments.

Figure 1:
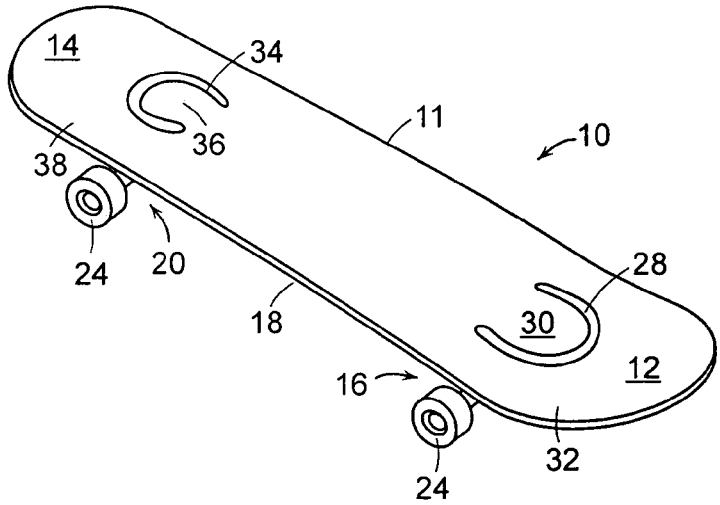
FIG. 1 is a perspective view of a skateboard with a suspension system in accordance with a preferred embodiment of the present invention.

The figures referred to above are not drawn necessarily to scale and should be understood to present a representation of the invention, illustrative of the principles involved. Some features of the suspension system for a skateboard depicted in the drawings have been enlarged or distorted relative to others to facilitate explanation and understanding. The same reference numbers are used in the drawings for similar or identical components and features shown in various alternative embodiments. Suspension systems for skateboards as disclosed herein, would have configurations and components determined, in part, by the intended application and environment in which they are used.

DETAILED DESCRIPTION OF CERTAIN PREFERRED EMBODIMENTS

Figure 2:
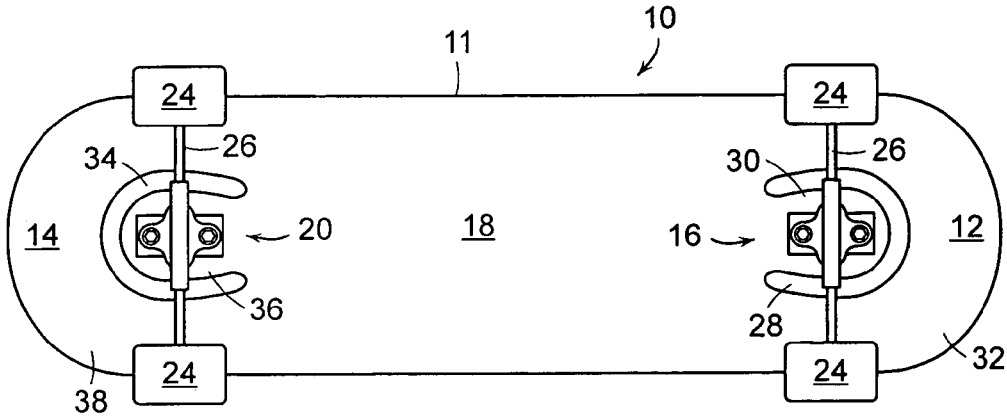
FIG. 2 is a plan view of the bottom of the skateboard of FIG. 1.

The present invention may be embodied in various forms. A preferred embodiment of a skateboard 10 is shown in FIGS. 1–2. Skateboard 10 is formed of a board 11 having a tip portion 12 and a tail portion 14. A front truck 16 is secured to a lower surface 18 of board 11 in tip portion 12. A rear truck 20 is secured to lower surface 18 of board 11 in tail portion 14. A pair of wheels 24 is secured to opposed ends of an axle 26 on each of front and rear trucks 16, 20.

A substantially U-shaped first aperture 28 is formed in tip portion 12, and defines a first cantilever 30 bounded by first aperture 28 and a first peripheral lip 32 surrounding first aperture 28. Cantilever 30 has a substantially U-shaped exposed outer edge. An open end of the U-shape of first aperture 28 opens toward a central portion of board 11. Front truck 16 is secured to lower surface 18 of cantilever 30 such that first aperture 28 substantially surrounds front truck 16.

A substantially U-shaped second aperture 34 is formed in tail portion 14, and defines a second cantilever 36 bounded by second aperture 34 and a second peripheral lip 38 surrounding second aperture 34. Cantilever 36 has a substantially U-shaped exposed outer edge. An open end of the U-shape of second aperture 34 opens toward a central portion of board 11. Rear truck 18 is secured to lower surface 18 of cantilever 36 such that second aperture 34 substantially surrounds rear truck 18.

Cantilevers 30, 36 act as springs for the user, since they can flex upwardly and downwardly. The spring action from cantilevers 30, 36 and first and second peripheral lips 32, 38 provides additionally flexibility for board 11, allowing a user to more easily maneuver the board to turn and perform tricks. Additionally, the increased flexibility of the board improves the shock absorption capabilities of board 11.

Figure 3:
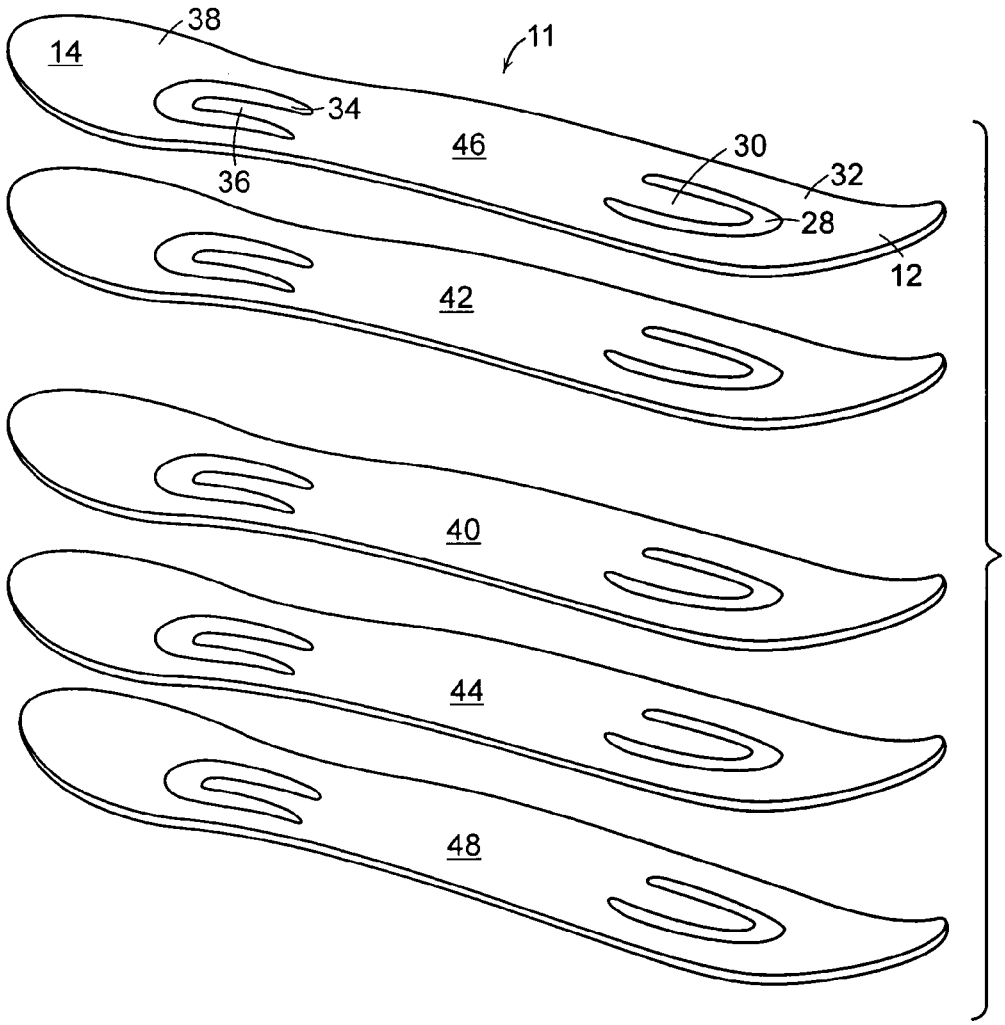
FIG. 3 is a perspective view, in exploded form, of a preferred embodiment of the board of the skateboard of FIG. 1, showing the layers that make up the board.

As is typical with skateboards, board 11 may be formed of a plurality of layers. In the embodiment illustrated in FIG. 3, board 11 is formed of five layers, laminated together in known fashion. A central layer 40 is formed of a foam, such as polyurethane. A first inner layer 42 is positioned adjacent an upper surface of central layer 40, and is preferably formed of fiberglass, or wood. A second inner layer 44 is positioned adjacent a lower surface of central layer 40, and is also preferably formed of fiberglass, or wood. A first outer layer 46 is positioned adjacent an upper surface of first inner layer 42, and is preferably formed of wood. A second outer layer 48 is positioned adjacent a lower surface of second inner layer 44, and is also preferably formed of wood. First and second apertures 28, 34 extend through each of the five layers that form board 11.

It is to be appreciated that many different materials, and combinations of materials, may be used to make up the layers of board 11. The wood-fiberglass-foam-fiberglass-wood combination described above is just one of a myriad of combinations that is possible for the construction of board 11. It is to be appreciated that board 11 may, in certain preferred embodiments, be formed of a single layer.

Figure 4:
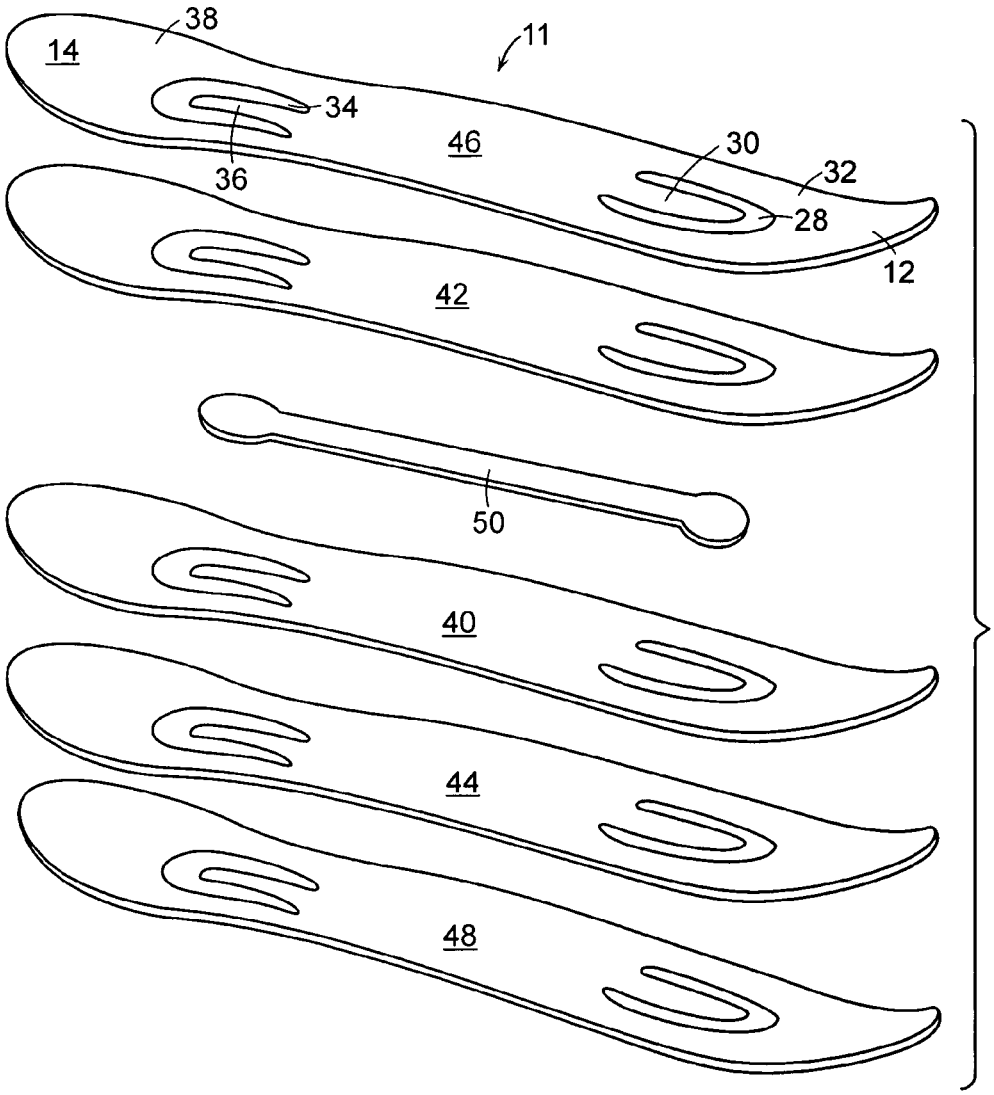
FIG. 4 is a perspective view, in exploded form, of an alternative embodiment of the board of FIG. 1, shown with a spine positioned within the board.

In a preferred embodiment, as seen in FIG. 4, a spine 50 is positioned within board 11, and preferably extends from first cantilever 30 to second cantilever 36. Spine 50 reinforces and strengthens board 11, improving its torsional rigidity and reducing the possibility of cantilevers 30, 36 and first and second peripheral lips 32, 38 snapping during use. Cantilevers 30, 36, spine 50, and first and second peripheral lips 32, 38 add to the spring characteristics of board 11, allowing tip 12 and tail 14 to flex more around cantilevers 30, 36. Cantilevers 30, 36, spine 50, and first and second peripheral lips 32, 38 also allow more energy to be stored in board 11 as it flexes, thereby allowing a user to jump higher. Further, cantilevers 30, 36, spine 50, and first and second peripheral lips 32, 38 also allow board 11 to flex in more locations, increasing the performance and flexibility of board 11 for the user.

In the illustrated embodiment, spine 50 is an elongate member positioned between central layer 40 and second inner layer 42, and is laminated together with all of the layers of board 11. It is to be appreciated that spine 50 could be positioned elsewhere in board 11. For example, spine 50 could be positioned between central layer 40 and second inner layer 44. In another preferred embodiment, spine 50 could be formed within central layer 40. In an embodiment where central layer 40 is formed of foam, central layer 40 could be molded around spine 50.

In certain preferred embodiments, spine 50 is formed of a carbon fiber composite. Spine 50 may also be formed of spring steel, titanium, or any other suitable material that will provide strength to board 11, while still allowing adequate flex of board 11. It is to be appreciated that in certain preferred embodiments, as noted above, board 11 could be formed of a single layer. In embodiments where board 11 is a single layer, it may be formed of a carbon fiber composite, spring steel, titanium, or any other suitable material.

Figure 5:
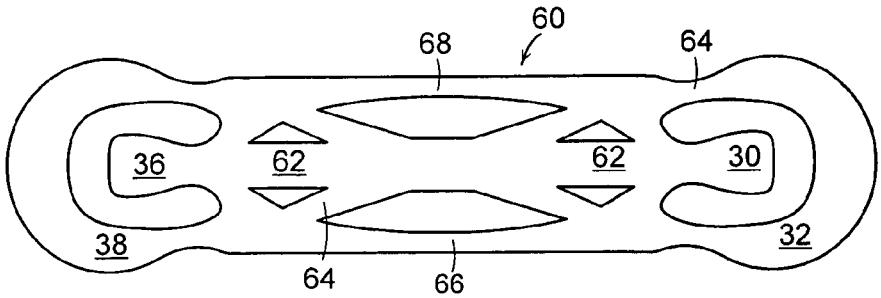
FIG. 5 is a plan view of an alternative embodiment of the spine of FIG. 4.

In another preferred embodiment, as seen in FIG. 5, a spine 60 is shown to have a more complex shape than the embodiment illustrated in FIG. 4. Spine 60 includes an elongate first portion 62, similar in shape to spine 50, which extends from first cantilever 30 of board 11 to second cantilever 36. A substantially figure-eight shaped portion 64 extends around first peripheral lip 32, across and down spine 60 to second peripheral lip 38, around second peripheral lip 38, and back up and across spine 60 to first peripheral lip 32. Elongate first and second lateral portions 66, 68 of spine 60 are positioned outward of elongate portion 62, and are connected at opposed ends thereof to figure-eight shaped second portion 64.

Figure 6:
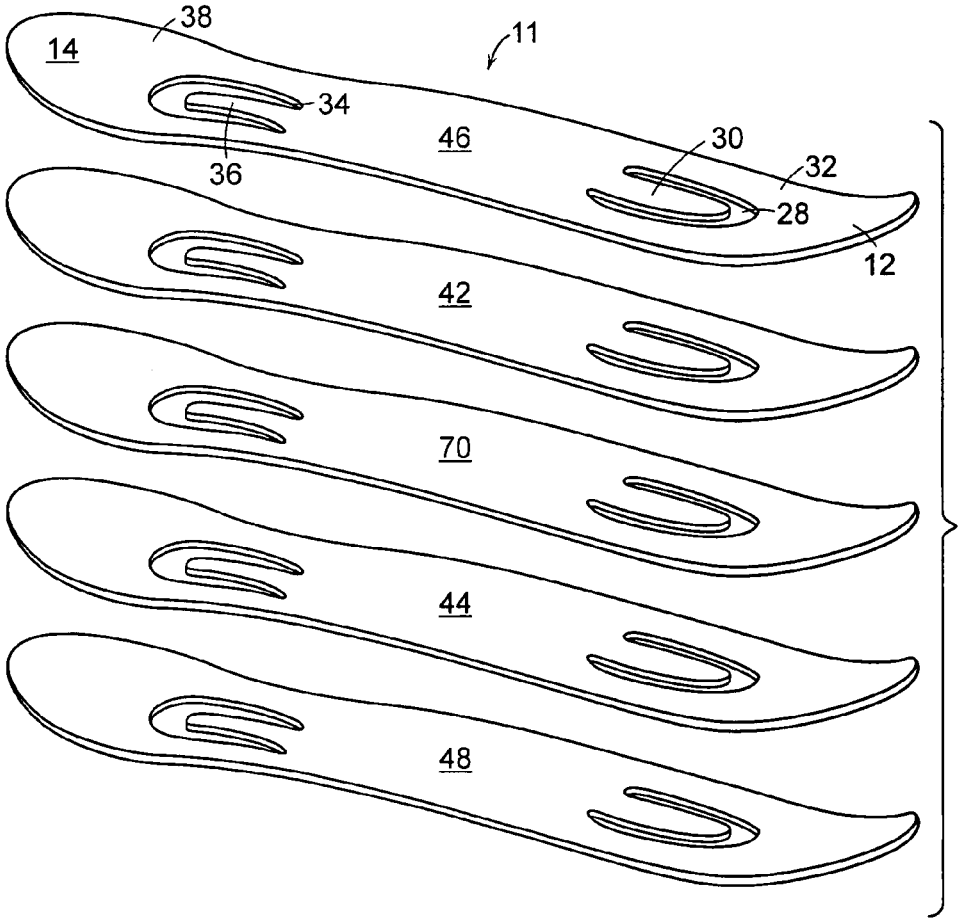
FIG. 6 is a perspective view, in exploded form, of an alternative embodiment of the board of FIG. 1, shown with a spine positioned within the board.

In another preferred embodiment, a spine could be formed in board 11 by positioning a spine 70 as a central layer of board 11, as seen in FIG. 6. In such an embodiment, board 11 comprises spine 70, first and second inner layers 42, 44 adjacent spine 70, and first and second outer layers 46, 48 adjacent first and second inner layers 42, 44, respectively. In the embodiment illustrated here, spine 70 has the same shape as each of the other layers. It is to be appreciated that in embodiments where spine 70 takes the place of a central layer, spine 70 is not limited to having the same shape as the other layers, and may have a shape as illustrated in FIGS. 4–5, or it may have any alternative shape.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A skateboard comprising, in combination:

a board having a tip portion and a tail portion;

a substantially U-shaped first aperture formed in the tip portion and defining a first cantilever, an open end of the first aperture opening toward a central portion of the board; and a substantially U-shaped second aperture formed in the tail portion and defining a second cantilever, an open end of the second aperture opening toward a central portion of the board.

2. The skateboard of claim 1, wherein the board comprises a plurality of layers laminated together.

3. The skateboard of claim 1, wherein the board comprises a core layer, a first inner layer adjacent an upper surface of the core layer, a second inner layer adjacent a lower surface of the core layer, a first outer layer adjacent an upper surface of the first inner layer, and a second outer layer adjacent a lower surface of the second inner layer.

4. The skateboard of claim 3, wherein the core layer is formed of a foam material.

5. The skateboard of claim 3, wherein the first and second inner layers are each formed of fiberglass.

6. The skateboard of claim 3, wherein the first and second inner layers are each formed of wood.

7. The skateboard of claim 3, wherein the first and second outer layers are each formed of wood.

8. The skateboard of claim 1, further comprising a spine positioned within the board.

9. The skateboard of claim 8, wherein the spine is comprised of a carbon fiber composite.

10. The skateboard of claim 8, wherein the spine extends from the first cantilever defined by the first aperture to the second cantilever defined by the second aperture.

11. The skateboard of claim 8, wherein the spine comprises an elongate first portion that extends from the first cantilever defined by the first aperture to the second cantilever defined by the second aperture;

a substantially figure-eight shaped second portion that extends around a first peripheral lip defined by the first aperture and around a second peripheral lip defined by the second aperture; and a pair of elongate lateral portions, each of which is positioned outward of the first portion and is connected at opposed ends thereof to the substantially figure-eight shaped second portion.

12. The skateboard of claim 1, wherein the board comprises a spine, a pair of inner layers adjacent the spine, and a pair of outer layers adjacent the inner layers.

13. A skateboard assembly comprising, in combination:

a board having a tip portion and a tail portion;

a first truck secured to the tip portion of the board and having an axle and a wheel rotatably secured to each end of the axle;

a second truck secured to the tail portion of the board and having an axle and a wheel rotatably secured to each end of the axle;

a substantially U-shaped first aperture formed in the board and defining a first cantilever and substantially surrounding the first truck, an open end of the first aperture opening toward a central portion of the board; and a substantially U-shaped second aperture formed in the board and defining a second cantilever and substantially surrounding the second truck; an open end of the second aperture opening toward a central portion of the board.

14. The skateboard assembly of claim 13, wherein the board comprises a plurality of layers laminated together.

15. The skateboard assembly of claim 13, wherein the board comprises a core layer, a first inner layer adjacent an upper surface of the core layer, a second inner layer adjacent a lower surface of the core layer, a first outer layer adjacent an upper surface of the first inner layer, and a second outer layer adjacent a lower surface of the second inner layer.

16. The skateboard assembly of claim 15, wherein the core layer is formed of a foam material.

17. The skateboard assembly of claim 15, wherein the first and second inner layers are each formed of fiberglass.

18. The skateboard assembly of claim 15, wherein the first and second inner layers are each formed of wood.

19. The skateboard assembly of claim 15, wherein the first and second outer layers are each formed of wood.

20. The skateboard assembly of claim 13, further comprising a spine positioned within the board.

21. The skateboard assembly of claim 20, wherein the spine extends from the first cantilever defined by the first aperture to the second cantilever defined by the second aperture.

22. The skateboard assembly of claim 20, wherein the spine comprises an elongate first portion that extends from the first cantilever defined by the first aperture to the second cantilever defined by the second aperture;

a substantially figure-eight shaped second portion that extends around a first peripheral lip defined by the first aperture and around a second peripheral lip defined by the second aperture; and a pair of elongate lateral portions, each of which is positioned outward of the first portion and is connected at opposed ends thereof to the substantially figure-eight shaped second portion.

23. The skateboard assembly of claim 20, wherein the spine is comprised of a carbon fiber composite.

24. The skateboard assembly of claim 13, wherein the board comprises a spine, a first inner layer adjacent an upper surface of the spine, a second inner layer adjacent a lower surface of the spine, a first outer layer adjacent an upper surface of the first inner layer, and a second outer layer adjacent a lower surface of the second inner layer.

25. A skateboard comprising, in combination:

a board having a tip portion and a tail portion, the board comprising a core layer;

a first inner layer adjacent an upper surface of the core layer;

a second inner layer adjacent a lower surface of the core layer;

a first outer layer adjacent an upper surface of the first inner layer; and a second outer layer adjacent a lower surface of the second inner layer;

a spine positioned within the board;

a substantially U-shaped first aperture formed in the tip portion and defining a first cantilever, an open end of the first aperture opening toward a central portion of the board; and a substantially U-shaped second aperture formed in the tail portion and defining a second cantilever, an open end of the second aperture opening toward a central portion of the board.

26. The skateboard of claim 25, wherein the spine is comprised of a carbon fiber composite.

27. The skateboard of claim 25, wherein the spine extends from the first cantilever defined by the first aperture to the second cantilever defined by the second aperture.

28. The skateboard of claim 25, wherein the spine comprises an elongate first portion that extends from the first cantilever defined by the first aperture to the second cantilever defined by the second aperture;

a substantially figure-eight shaped second portion that extends around a first peripheral lip defined by the first aperture and around a second peripheral lip defined by the second aperture; and a pair of elongate lateral portions, each of which is positioned outward of the first portion and is connected at opposed ends thereof to the substantially figure-eight shaped second portion.

* * * * *